US007909419B2

(12) United States Patent
Vinke

(10) Patent No.: US 7,909,419 B2
(45) Date of Patent: Mar. 22, 2011

(54) RESTRICTED ACCESS STORAGE COMPARTMENT

(75) Inventor: Bradley H. Vinke, Grand Valley (CA)

(73) Assignee: Spacesaver Corporation, Fort Atkinson, WI (US)

( * ) Notice: Subject to any disclaimer, the term of this patent is extended or adjusted under 35 U.S.C. 154(b) by 410 days.

(21) Appl. No.: 12/116,719

(22) Filed: May 7, 2008

(65) Prior Publication Data

US 2009/0278426 A1 Nov. 12, 2009

(51) Int. Cl.
*E05B 65/46* (2006.01)

(52) U.S. Cl. ..... 312/215; 292/32; 292/37; 292/40; 109/68

(58) Field of Classification Search ..... 312/215–219; 49/395; 292/DIG. 37, 32, 33, 38, 42, 37, 292/40; 109/67, 68
See application file for complete search history.

(56) References Cited

U.S. PATENT DOCUMENTS

| | | | | | |
|---|---|---|---|---|---|
| 2,772,905 | A * | 12/1956 | Dusing | 292/36 |
| 3,337,281 | A * | 8/1967 | Walhout | 312/217 |
| 3,809,415 | A * | 5/1974 | Westcott | 292/33 |
| 3,966,247 | A | 6/1976 | Muller, Jr. et al. | |
| 4,146,994 | A * | 4/1979 | Williams | 49/367 |
| 4,500,122 | A * | 2/1985 | Douglas | 292/161 |
| 4,679,415 | A | 7/1987 | Spratt | |
| 5,154,500 | A * | 10/1992 | Chang | 312/258 |
| 5,341,752 | A | 8/1994 | Hambleton | |
| 5,375,894 | A * | 12/1994 | Schlack | 292/36 |
| 5,794,467 | A | 8/1998 | Justice | |
| 5,992,188 | A | 11/1999 | Saunders | |
| 6,185,773 | B1 | 2/2001 | Goedde | |
| 6,681,604 | B1 * | 1/2004 | Samsel | 70/78 |
| 7,001,001 | B1 * | 2/2006 | Spencer | 312/219 |
| 7,178,716 | B2 * | 2/2007 | Yong | 232/45 |
| 7,183,903 | B2 | 2/2007 | Nicolson et al. | |
| 7,261,328 | B2 * | 8/2007 | Minix | 292/28 |
| 7,318,632 | B2 * | 1/2008 | Bidinger et al. | 312/319.9 |
| 2003/0151337 | A1 * | 8/2003 | Leccia et al. | 312/326 |

* cited by examiner

*Primary Examiner* — Janet M Wilkens
*Assistant Examiner* — Dan Rohrhoff
(74) *Attorney, Agent, or Firm* — Andrus, Sceales, Starke & Sawall, LLP

(57) ABSTRACT

A locker that may either be opened in a keyed or keyless manner includes a locking mechanism formed predominantly of sheet components. The locking mechanism is designed to be carried by the frame of the locker, and is particularly suited to enable the locker to be used as an evidence locker or similar restricted access storage compartment. Various spring biases are used to force the locking mechanism to a locked position when the locking mechanism is appropriately triggered, such as by a pushbutton. The locking mechanism is designed to be substantially tamper proof and cannot be reset to an unlocked position without a key, if equipped, or access to a lock resetting lever arm that is only accessible through a rear opening of the locker.

21 Claims, 6 Drawing Sheets

RESTRICTED ACCESS STORAGE COMPARTMENT

BACKGROUND OF THE INVENTION

The present invention relates generally to locker and similar storage compartments and, more particularly, to a restricted access storage compartment particularly suited for storing evidence and/or weapons that includes a housing-carried locking mechanism adapted to prevent access to the storage compartment once the locking mechanism is actuated.

Evidence lockers, and similar types of storage compartments, such as property lockers, are commonly used by law enforcement organizations to store evidence, e.g., weapons, contraband, documents, etc. To limit access to the evidence and therefore preserve the chain of custody, a locked evidence locker is designed to be inaccessible by anyone other than an authorized officer, such as a property officer or evidence room clerk. Generally, there are two types of evidence lockers: key and keyless. With a keyed evidence locker, the property officer must use a key to open the front of the evidence locker and gain access to the materials stored therein. With a keyless evidence locker, a rear panel of the locker may be opened to access the interior of the storage compartment rather than opening the front of the locker. Keyless evidence lockers are used when the rear of the locker may be accessed from within a property or evidence room yet the front of the locker may only be accessed from outside the property room. Generally, such keyless evidence lockers are stacked and effectively form part of the wall of the property room. In contrast, keyed evidence lockers are stacked against, rather than forming part of, a wall of the property room.

In general, when evidence is to be placed into an evidence locker, a law enforcement officer, court official, or evidence clerk will place the evidence inside an opened locker. A locking mechanism carried by the door of the locker is then actuated, such as by a push button, to lock the door of the locker to the frame of the locker. The locker will remain locked until unlocked by an authorized evidence clerk or property officer.

Numerous advancements have been made in improving the design and functionality of evidence locker and similar restricted access storage compartment. These advancements have included improving the strength of the locker as well as the construction of the locking mechanism in an effort to make the locker more tamper-proof. Notwithstanding these advancements, there remains a need to further improve the design of both keyed and keyless lockers. There is particularly a need to design an evidence locker that can be more efficiently manufactured without sacrificing the performance of the evidence locker.

SUMMARY OF THE INVENTION

In accordance with one aspect of the invention, the present invention is directed to a locker designed for restricted access that includes a storage member defining a storage cell having a front access opening and a front door coupled to the storage member and adapted to close the front access opening when the front door is in a closed position. The locker further includes a lock assembly carried by the frame of the locker that, when activated, causes a pair of locking members to engage the front door to secure it to the storage member thereby restricting access to the storage cell through the front access opening.

In accordance with another aspect, the invention is directed to a locker having a frame defining a storage compartment that includes an opening permitting access to an interior of the storage compartment. The locker also includes a door operable to close the opening to restrict access to the interior of the storage compartment. A lock is carried by the frame of the locker and is operative to lock the door to the frame. The lock includes a pair of locking members movable between a retracted position and an extended position, which are designed to be received in the frame when in the extended position. An actuator is operably linked with the pair of locking members to force the locking members from the retracted position to the extended position when actuated.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
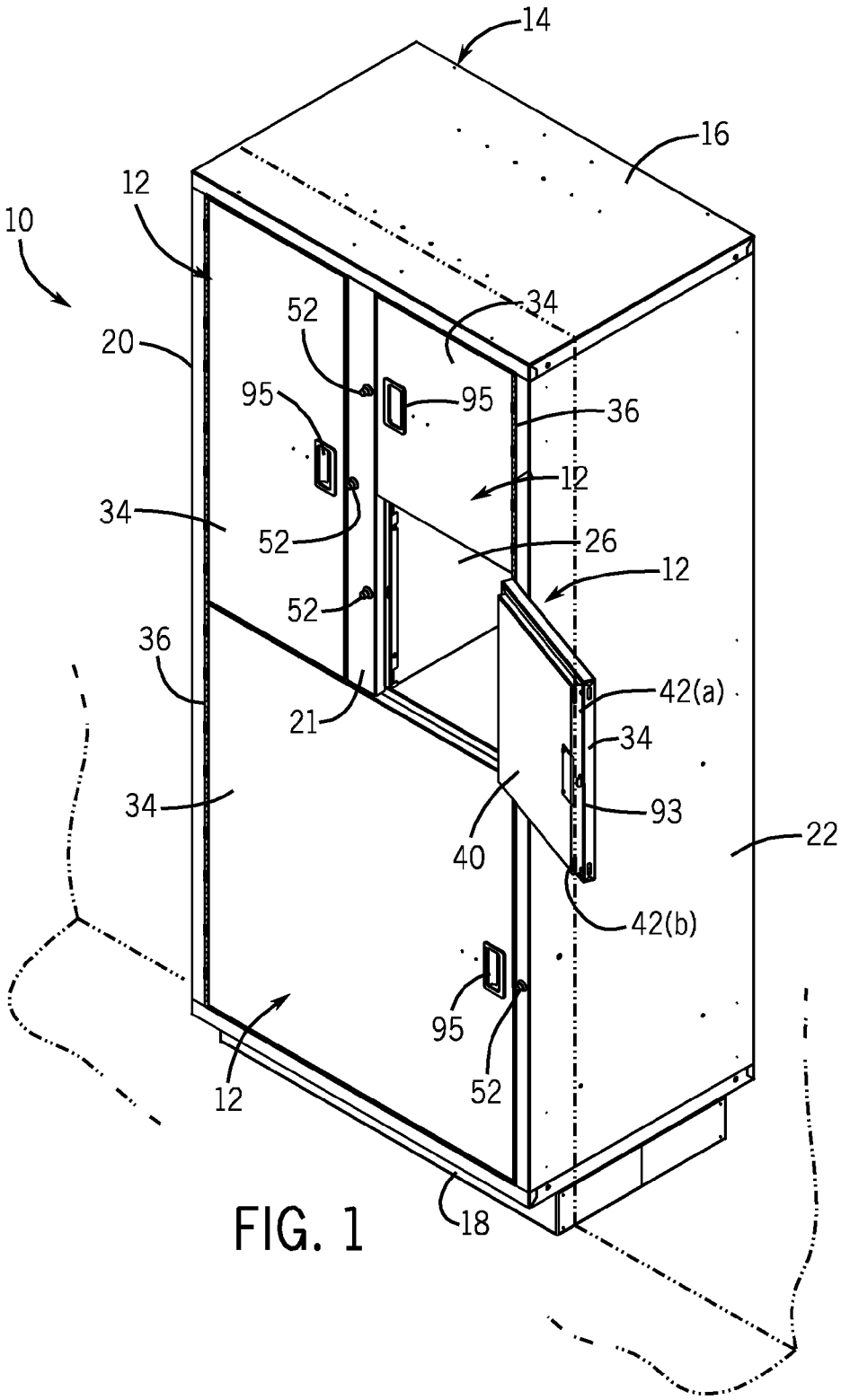
FIG. 1 is an isometric view of an array of keyless evidence lockers with each evidence locker having a multipoint locking mechanism according to one embodiment of the present invention to selectively lock the evidence lockers.
Figure 2:
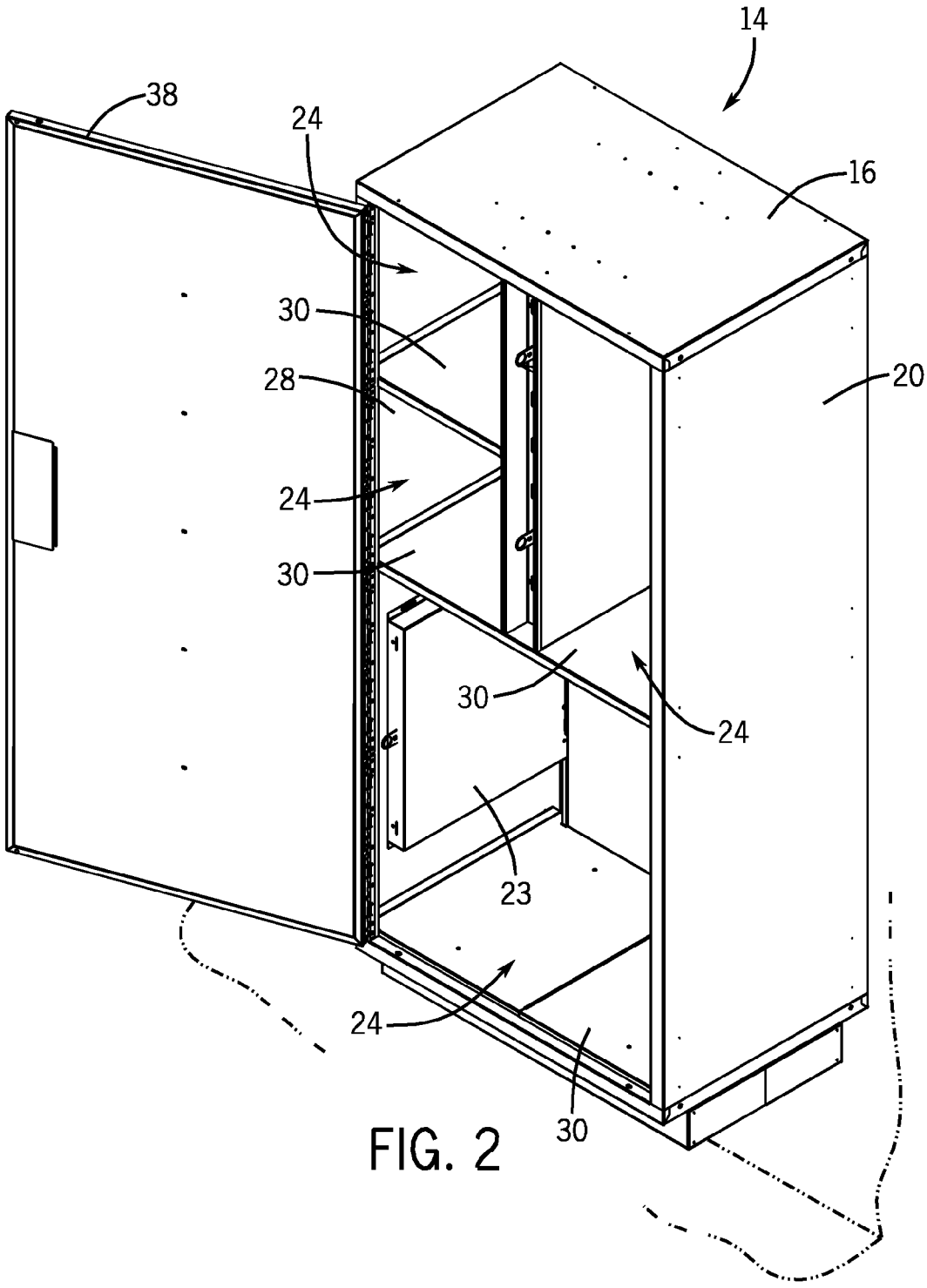
FIG. 2 is a rear isometric view of the array shown in FIG. 1 with a rear door in an open position.

A group of keyless evidence lockers stacked in an array or bank 10 is shown in FIGS. 1 and 2. In one representative embodiment, the four evidence lockers 12 are stacked randomly; although, the invention is not limited to such an arrangement. The evidence lockers 12 share a frame 14 that includes a top panel 16, a base panel 18, and a pair of side panels 20 and 22. The frame members may be fastened together in a conventional manner, such as welding, or formed as an integrated unit in a conventional manner. Each evidence locker 12 defines a storage cell 24 having a front opening 26 and a rear opening 28. The openings 26, 28 are defined by the aforementioned side panels 20, 22 and a cell lower panel 30 and a cell upper panel 32. The cell lower panel 30 effectively defines the cell upper panel for the below adjacent evidence locker 12. Similarly, the cell upper panel effectively defines the cell lower panel for the above adjacent evidence locker 12. The front opening 26 may be closed by a door 34 connected to side panel 22 using hinges 36. In the illustrated example, the doors 34 of each evidence locker 12 are pulled open about side panel 20 or 22 depending on what side of the bank the door 34 is located. The rear opening 28 is closed by a rear door 38 that in the illustrated embodiment is coupled to the side panel 22, but is understood that the rear door 38 could be connected to the opposite side panel 20. Each front door 34 has a stiffener bracket 40 that includes two slots 42(*a*), 42(*b*) for locking points (not shown) of a lock mechanism 44 to engage when the door 34 is locked.

Figure 3:
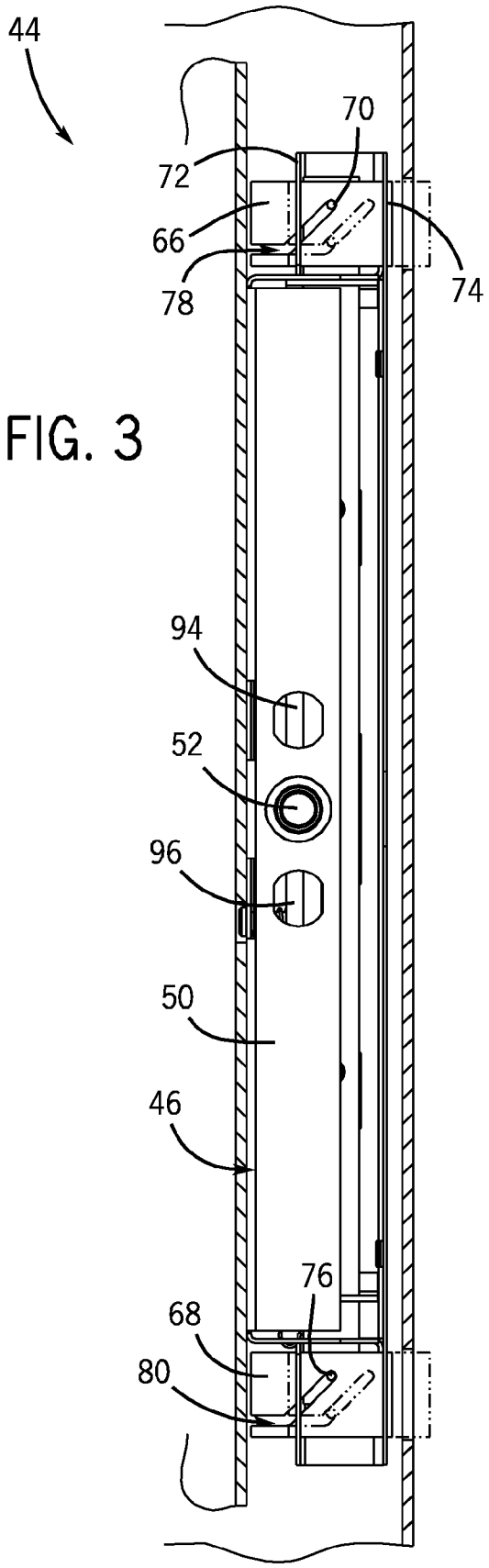
FIG. 3 is front elevation view, with portions in section, of a locking mechanism in accordance with the present invention that is incorporated into each of the evidence lockers shown in FIGS. 1 and 2.
Figure 5:
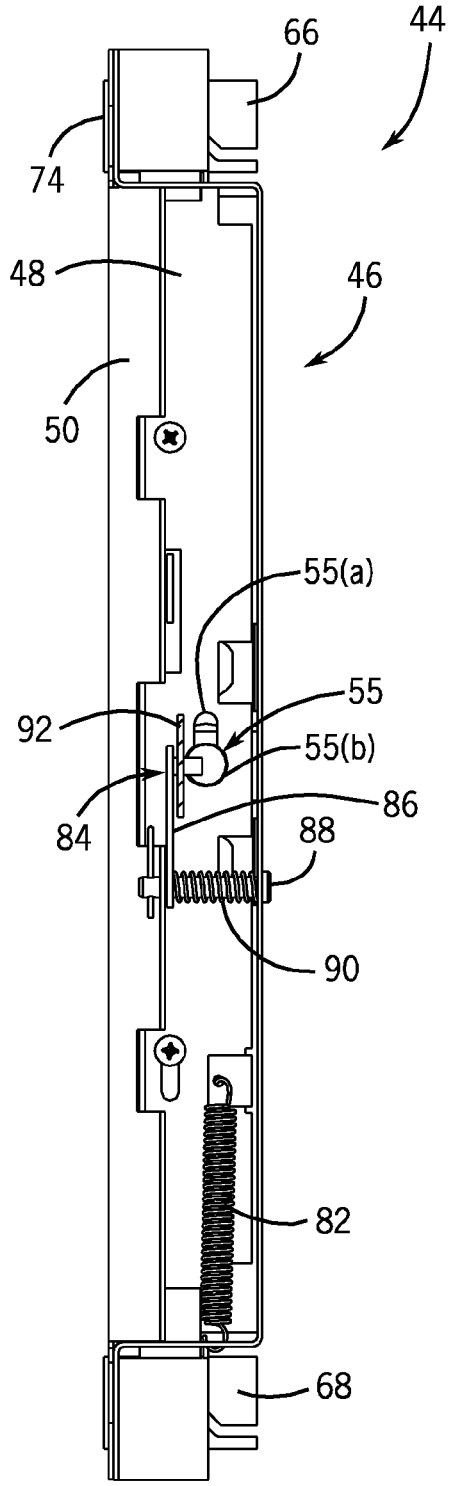
FIG. 5 is a rear elevation view of the locking mechanism of FIGS. 3 and 4.
Figure 4:
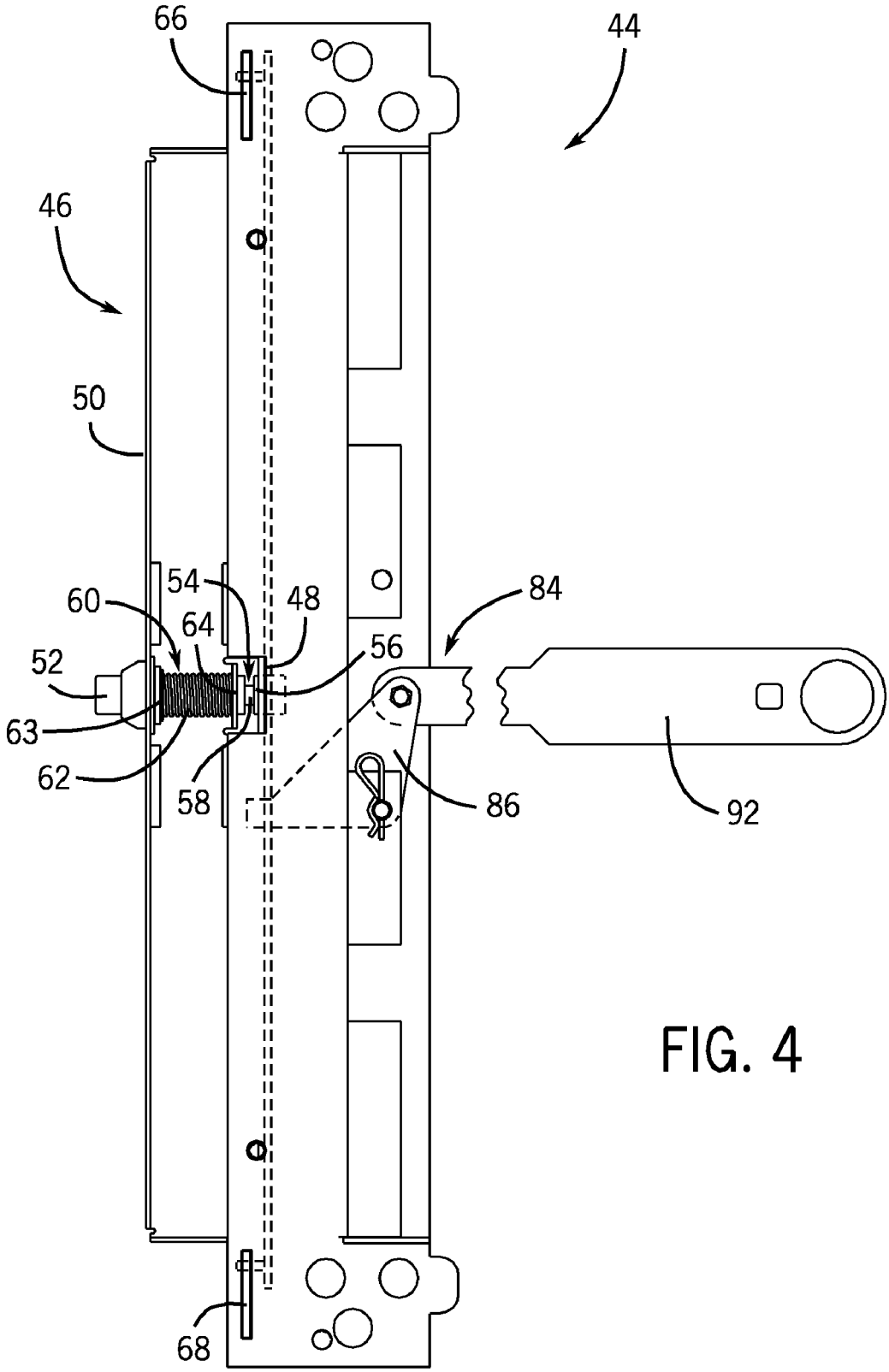
FIG. 4 is a side elevation view of the locking mechanism of FIG. 3.

FIGS. 3 through 5 show a keyless, multipoint locking mechanism 44 according to one embodiment of the invention. The locking mechanism 44 has a housing 46 that is integrated into the locker center divider 21 or may also be integrated into a lock mount bracket 23 when a center divider is not provided or when the door locks adjacent one of the side panels. An inner slide 48 is connected to the housing 46 and allowed to slide vertically within the interior of the housing 46. The housing 46 also has an outer frame member 50 through which a pushbutton 52 extends. The pushbutton 52 is associated with an actuator member 54 that extends into a keyhole shaped opening 55 in the inner slide 48. Opening 55 includes a slot portion 55(*a*) and a circular portion 55(*b*). The actuator member 54 has a larger diameter portion 56 and a smaller diameter portion 58. The smaller diameter portion 58 is concentric with the larger diameter portion 56 and therefore effectively forms a ring. The larger diameter portion 56 of the actuator member 54 provides a seat for the boundary of the keyhole shaped opening 55 formed in the inner slide 48 when the inner slide 48 is in a retracted position and the smaller diameter portion 58, or ring, provides a seat for the boundary of the keyhole shaped opening 55 when the inner slide 48 is in an extended position, as will be described.

A spring latch 60 interconnects the pushbutton 52 with the actuator member 54. The spring latch 60 includes a compression spring 62. When the inner slide 48 is in a retracted position, the compression spring 62 is extended. More particularly, the spring latch 60 includes a circlip 63 that is coupled to the pushbutton 52 and therefore linked with the actuator member 54. When the pushbutton 52 is depressed, the spring 62 is compressed between the circlip 63 and the plate 64. The inner slide 48 and pushbutton 52 are both biased towards the extended position. When the pushbutton is depressed it causes the smaller diameter portion 58 of the actuator member 54 to enter into the keyhole shaped opening 55 of the inner slide 48, which in turn allows the inner slide 48 to move to its extended position. The larger diameter portion 56 of actuator member 54 is bigger than the smaller portion of the keyhole shaped slot 55(*a*) which in turn keeps the push button depressed. When the inner slide 48 is forced back to its retracted position the larger diameter portion 56 lines up with the circular portion 55(*b*) of the keyhole shaped opening 55 allowing pushbutton 52 to return to its extended position The locking mechanism 44 also includes a pair of locking points, which in the illustrated embodiment include a pair of locking members in the form of locking bolts 66 and 68. Locking bolt 66 is mounted on a guide pin 70 and is retained by a pair of frame members 72 and 74 in a manner that allows the locking bolt 66 to slide linearly. Similarly, locking bolt 68 is mounted on a guide pin 76 and retained by the pair of frame members 72, 74 in a manner that allows the locking bolt 68 to slide linearly. Each locking bolt 66, 68 has a guide channel 78, 80, respectively, that defines a path along which the respective guide pins 70, 76 travel.

The locking bolts 66, 68 are biased toward an extended position via an extension spring 82 that urges the inner slide 48 toward the extended or locked position. The extension spring 82 is interconnected between the housing 46 and the inner slide 48. When the inner slide 48 is in the retracted position, the extension spring 82 is extended. Likewise, movement of the inner slide 48 to the extended position compresses the extension spring 82, which biases the inner slide 48 toward the extended position.

A rear release cam assembly 84 is used to place the inner slide 48 in the retracted position, which also results in the extension of the pushbutton 52 and the retraction of the locking bolts 66, 68. The cam assembly 84 includes a cam member 86 that is coupled to the inner slide 48 by a clevis pin 88. The clevis pin 88 extends through a compression spring 90 that is sandwiched between the inside surface of the front frame member 50 and the cam member 86. A lever arm 92 is pinned to the cam member 86 and is used to retract the inner slide 48 and extend pushbutton 52. The lever arm 92 is of sufficient length to extend to the rear opening 28 of the storage cell 24. Thus, a property clerk can move the locking mechanism 44 to its unlocked position by pulling on arm 92 to rotate the cam member 86 upward, which resets the door 34 to its unlocked state.

Operation of the locking mechanism 44 will now be described in a series of steps. For purposes of description, the steps will begin with opening of the evidence locker 12 to place evidence therein and conclude with the unlocking of the evidence locker 12 by a property clerk without use of a key.

First, an officer, court official, or other authorized evidence handler chooses an empty, unlocked evidence locker 12. The locking mechanism 44 is in an unlocked position characterized by the pushbutton 52 being an extended position and the locking bolts 66 and 68 being in retracted positions. The positions of the pushbutton 52 and the bolts 66, 68 is a function of the position of the inner slide 48 being forced into a retracted position by cam member 86.

Once the evidence is placed into the storage cell 24 of the evidence locker, the door 34 is closed and the pushbutton 52 is depressed to lock the door 34 to the locker frame 14. When the pushbutton 52 is depressed, the actuator member 54 moves linearly away from the front frame member 50. The larger diameter portion 56 of the actuator member 54 moves through the opening in the inner slide 48 until the boundary of the opening seats in the ring or smaller diameter portion 58 of the actuator member. The change in diameter of the actuator member 54 allows the bias of spring 82 to force the inner slide 48 from a retracted position to an extended position. In this regard, the guide pins 70, 76, which are connected to the inner slide 48, effectively move closer to the actuator member 54 by a distance equal to the distance between the center of the circular diameter portion 55(*b*) of the keyhole shaped opening 55 and the center of the slot portion 55(*a*) of the keyhole shaped opening 55. This movement of the guide pins 70, 76 allows the bolts 66, 68 to move transversely with the movement of the inner slide 48, by operation of movement of the guide pins 70, 76 along guide channels 78, 80, respectively. This transverse movement of the locking bolts 66, 68 forces the locking bolts 66, 68 into engagement with corresponding slots in the stiffener bracket 40 on the door 34 thereby locking the door 34 closed. Moreover, since the pushbutton 52 is retracted, further depressing of the pushbutton 52 has no impact on the locking mechanism 44. In other words, the locking mechanism 44 cannot be unlocked by depressing pushbutton 52.

The front door 34 can only be unlocked by a property office or similar authorized personnel using the lever arm 92 that is accessible only through the rear opening 28, as described above. The lever arm 92 effectively resets the locking mechanism 44 by retracting the locking bolts 66, 68 and extending the pushbutton 52 by moving the inner slide 48 from its extended position to its retracted position. It should be noted that the terms "extended" and "retracted" relative to the position of the inner slide 48 correspond to the position of the locking bolts 66, 68 rather than the position of the inner slide 48. In this regard, the "retracted" position of the inner slide 48 is, in effect, the first or unlocked position and the "extended" position of the inner slide 48 is, in effect, the second or locked position.

One skilled in the art will appreciate that the locking bolts 66, 68 extend into dedicated slots 42(*a*), 42(*b*) in the stiffener bracket 40 on the door 34 and that the lock mechanism is securely mounted to the locker frame 14. The locking bolts 66, 68 thus prevent the door 34 from being pulled away from the locker frame 14. The locker frame has an integral stop 93 that holds the door 34 flush with the face of the cabinet and it keeps the door 34 being pushed into the frame. It will be appreciated that the door 34 has a handle 95 that can be used as a door pull for grasping the door 34 and pulling it open.

Figure 6:
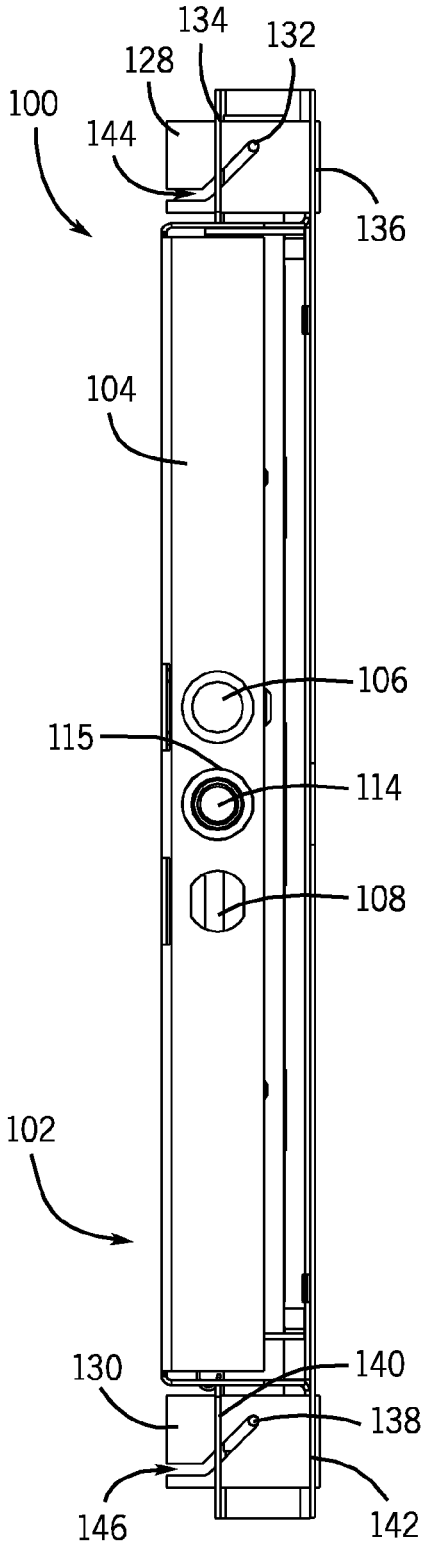
FIG. 6 is a front elevation view of a keyed locking mechanism with a top positioned keyhole according to an alternate embodiment of the present invention.
Figure 8:
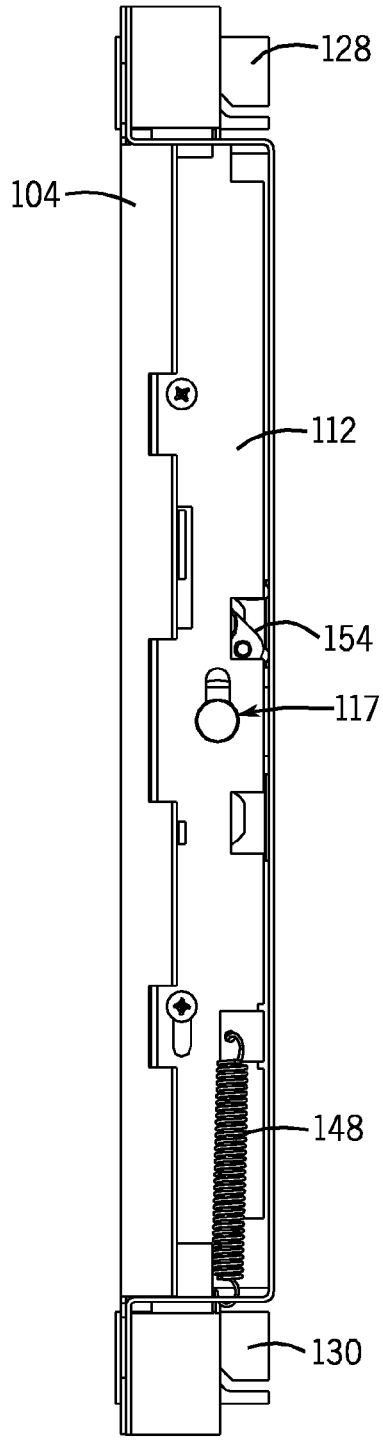
FIG. 8 is a rear elevation view of the keyed locking mechanism of FIGS. 6 and 7.
Figure 7:
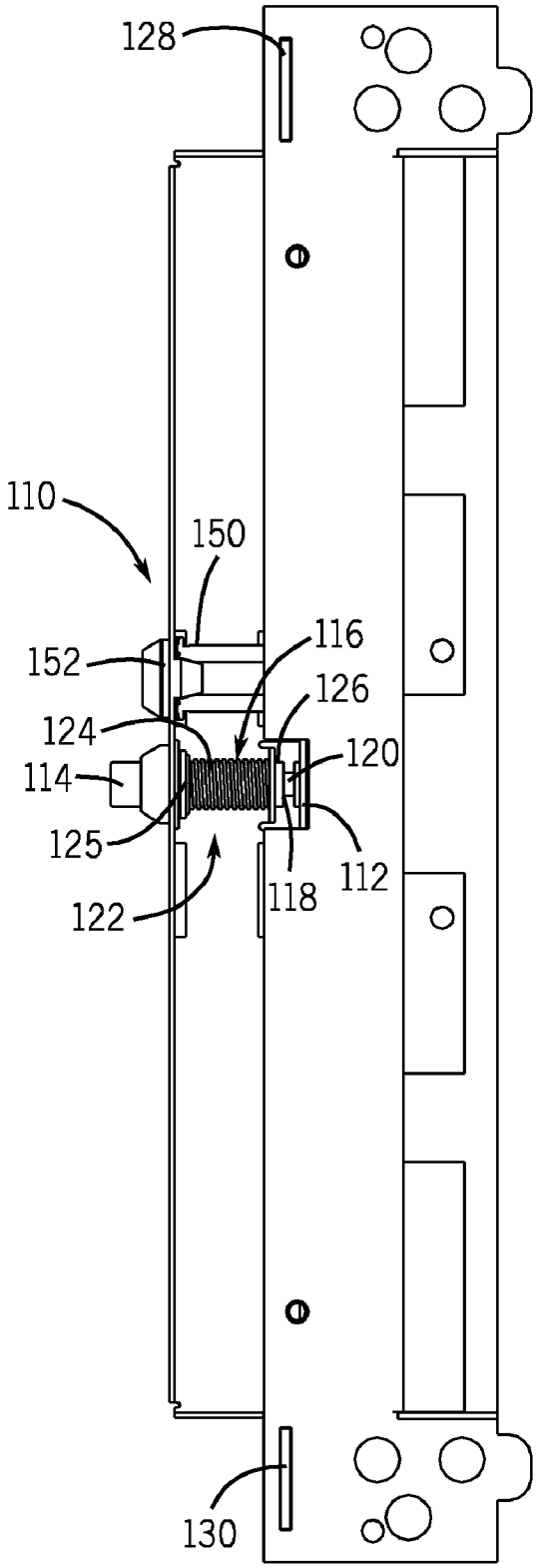
FIG. 7 is a side elevation view of the keyed locking mechanism of FIG. 6.

FIGS. 6 through 8 show a keyed locking mechanism 100 according to an alternate embodiment of the invention. The keyed locking mechanism is similar to the locking mechanism 44 described above, but requires a key for unlocking rather than a rear panel accessible lever arm as in the embodiment of FIGS. 3 through 5. The locking mechanism 100 has a housing 102 that includes a front frame member 104. The front frame member includes a tube lock 106 and an opening 108 that can house a tube lock for an alternate handed lock. Openings 106, 108 correspond to the same openings 94, 96 of the front frame member 50 of the previously described keyless locking mechanism 44. Thus, for locking mechanism 100, one of the openings is used as a keyhole 106 and the other is used for the alternate handed lock. In this regard, the same housing can be used for both keyless and keyed embodiments.

The housing 102 is designed to be integrated into a center divider or other locker frame member. An inner slide 112 is connected to the housing 102 and allowed to slide vertically within the interior of the housing 102. A pushbutton 114 extends through an opening 115 in the front frame member 104 centrally between the keyhole 106 and extra 103. The pushbutton 114 is associated with an actuator member 116 that extends into an opening 117 in the inner slide 112. The actuator member 116 has a larger diameter portion 118 and a smaller diameter portion 120. The smaller diameter portion 120 is concentric with the larger diameter portion 118 and therefore effectively forms a ring. The larger diameter portion of the actuator member 116 provides a seat for the boundary of the opening 117 formed in the inner slide 112 when the inner slide 112 is in a retracted position and the smaller diameter portion of the actuator member 116, or ring, provides a seat for the boundary of the opening 117 when the inner slide 112 is in an extended position, as will be described.

A spring latch 122 interconnects the pushbutton 114 with the actuator member 116. The spring latch 122 includes a compression spring 124. When the inner slide 112 is in a retracted position, the compression spring 124 is extended. More particularly, the spring latch 122 includes a circlip 125 that is coupled to the pushbutton 114. When the pushbutton 114 is depressed, the spring 124 is compressed between the circlip 125 and plate 126. The inner slide 112 and the pushbutton 114 are both biased towards the extended position. When the pushbutton is depressed it causes the smaller diameter portion of the actuator member 116 to enter into the keyhole shaped opening of the inner slide 112, which allows the inner slide 112 to move to its extended position. The larger diameter portion of the actuator member 116 keeps the pushbutton in the depressed position. When the inner slide 112 is forced back to its retracted position, the larger diameter portion of the actuator member 116 lines up with the larger portion of the opening 117 thereby allowing the pushbutton 114 to return to its extended position.

The locking mechanism 100 also includes a pair of locking points, which in the illustrated embodiment include a pair of locking members or bolts 128 and 130. Locking bolt 128 is mounted on a guide pin 132 and is retained by a pair of frame members 134 and 136 in a manner that allows the bolt 128 to slide linearly. Similarly, locking bolt 130 is mounted on a guide pin 138 and retained by the pair of frame members 140, 142 in a manner that allows that bolt 130 to slide linearly. Each locking bolt 128, 130 has a guide channel 144, 146, respectively, that defines a path along which the respective guide pins 132, 138 travel.

The locking bolts 128, 130 are biased toward an extended position when the inner slide 112 is in the extended or locked position by operation of an extension spring 148. The extension spring 148 is interconnected between the housing 102 and the inner slide 112, and is compressed when the inner slide 112 is in the extended position so as to bias the inner slide 112 toward the extended position.

The keylock assembly 110 includes a lock tube 150 that houses a barrel 152 that is linked with a cam assembly 154. When the appropriate key is inserted into the barrel 152 and rotated, the cam member assembly 154 returns the inner slide 112 to its unlocked position which retracts the bolts 128, 130 and extends the pushbutton 114. In this regard, a key inserted into barrel 152 and rotated imparts functionality similar to the lever arm described above.

It will be appreciated that the locking bolts described herein may take the form of flanges, pins, or other shaped locking points and, as such, the present invention is not limited to a particular shape or geometry for the locking bolts.

The present invention has been described with respect to an evidence locker but it is understood that the invention may also be applicable with other types of lockable storage compartments or containers. Additionally, while keyless and keyed evidence lockers have been described and shown, it is understood that the invention is also applicable with lockers and the like that may be unlocked electronically using a keypad, key-fob, or other type of electronic device.

Various alternatives and embodiments are contemplated as being within the scope of the following claims particularly pointing out and distinctly claiming the subject matter regarded as the invention.

I claim:

1. A locker designed for restricted access, comprising:

a locker frame having a storage compartment defining a storage cell having a front access opening;

a front door coupled to the storage compartment and adapted to close the front access opening when the front door is in a closed position; and a lock assembly carried by the locker frame that when activated causes a pair of locking members to engage the front door to secure the front door to the storage compartment thereby restricting access to the storage cell through the front access opening, wherein the lock assembly includes a first movable member having different peripheral portions selectively received in differently shaped receiving portions of a second movable member such that movement of one of the peripheral portions into engagement with one of the receiving portions enables movement of the second movable member relative to the first movable member causing the locking members to move from the retracted position to the extended position.

2. The locker of claim 1 further comprising a rear access opening and a rear door coupled to the storage compartment that permits access to the storage cell when in an open position and prevents access to the storage cell when in a closed position, and wherein the rear door may be opened when the front door is locked to the storage compartment by the lock assembly.

3. The locker of claim 2 further comprising a lock release proximate the rear access opening and operative to release engagement of the pair of locking members with the front door.

4. The locker of claim 1 wherein the lock assembly includes:

a lock assembly frame mounted to the storage compartment;

a slide that is slidable within the storage compartment and operative to force the pair of locking members from a retracted position to an extended position when slid from a first position to a second position; and an actuator carried by the storage compartment and forcibly biasing the slide toward the second position and when activated allowing the slide to move from the first position to the second position to cause the pair of locking members to move from the retracted position to the extended position.

5. The locker of claim 1 wherein the lock assembly includes a lock frame that is fabricated of sheet metal.

6. A locker comprising:

a frame defining a storage compartment having an opening to permit access to an interior of the storage compartment;

a door operable to close the opening to restrict access to the interior of the storage compartment;

a lock carried by the frame and operative to lock the door to the frame, the lock including:

first and second locking members movable between a retracted position and an extended position, wherein the locking members are designed to be received by the door when in the extended position; and an actuator operably linked with the locking members to force the locking members from the retracted position to the extended position when actuated, wherein the actuator includes a first movable member having different peripheral portions selectively received in differently shaped receiving portions of a second movable member such that movement of one of the peripheral portions into engagement with one of the receiving portions enables movement of the second movable member relative to the first movable member causing the locking members to move from the retracted position to the extended position.

7. The locker of claim 6 wherein the opening constitutes a first opening and the door constitutes a first door, and wherein the frame defines a second opening, opposite the first opening, for the storage compartment and further comprising a second door operable to close the second opening.

8. The locker of claim 7 further comprising a lock reset accessible through the second opening when the first opening is closed and the first door is locked to the storage compartment, the lock reset including a lever linked with the actuator to retract the locking members.

9. The locker of claim 6 wherein the actuator includes a bolt biased by a spring toward a first position and movable to a second position when the bias of the spring is overcome, and a slidable member operatively associated with the bolt such that the slidable member is slidable from a third position to a fourth position when the bolt is moved from the first position to the second position and wherein the slidable member is associated with the locking members so that movement of the slidable member from the third position to the fourth position causes the locking members to move from the retracted position to the extended position.

10. The locker of claim 9 wherein the slidable member includes a first pin designed to slide along a first groove in the first locking member when the slidable member moves from the third position to the fourth position and a second pin designed to slide along a second groove in the second locking member when the slidable member moves from the third position to the fourth position, and wherein said sliding of the pins allows the locking members to move from the retracted position to the extended position.

11. The locker of claim 10 wherein the first groove is formed diagonally in the first locking member and the second groove is formed diagonally in the second locking member.

12. A locker comprising:

a locker frame defining a storage compartment;

a door panel;

a mounting member connecting the door panel to the locker frame member in a manner that allows the door panel to be pivoted relative to the locker frame to selectively open and close the storage compartment; and a lock arrangement connected to the locker frame and proximate the storage compartment, the lock arrangement including:

a pair of locking members movable between a retracted position and an extended position, wherein the locking members are designed to be received by the door panel when in the extended position; and an actuator operably linked with the pair of locking members to force the locking members from the retracted position to the extended position when actuated, wherein the actuator includes a first movable member having different peripheral portions selectively received in differently shaped receiving portions of a second movable member such that movement of one of the peripheral portions into engagement with one of the receiving portions enables movement of the second movable member relative to the first movable member causing the locking members to move from the retracted position to the extended position.

13. The locker of claim 12 wherein the actuator includes a bolt biased by a spring in a first position and movable to a second position when the bias of the spring is overcome and a slidable member operatively associated with the bolt such that the slidable member is slidable from a third position to a fourth position when the bolt is moved from the first position to the second position and wherein the slidable member is associated with the locking members so that movement of the slidable member from the third position to the fourth position causes the locking members to move from the retracted position to the extended position.

14. The locker of claim 13 further comprising a cam slot and pin arrangement between the slidable member and the locking members for moving the locking members from the retracted position to the extended position when the slidable member is moved from the third position to the fourth position.

15. The locker of claim 13 wherein the lock arrangement is comprised of sheet metal.

16. The locker of claim 12 further comprising a stiffener bracket mounted to a backside of the door panel, and wherein the stiffener bracket includes a pair of slots configured to receive the pair of locking members.

17. A locker designed for restricted access, comprising:

a locker frame having a storage compartment defining a storage cell having a front access opening;

a front door coupled to the storage compartment and adapted to close the front access opening when the front door is in a closed position; and a lock assembly carried by the locker frame that when activated causes a pair of locking members to engage the front door to secure the front door to the storage compartment thereby restricting access to the storage cells through the front access opening, wherein the lock assembly includes:

a lock assembly frame mounted to the storage compartment;

a slide that is slidable within the storage compartment and operative to force the pair of locking members from a retracted position to an extended position when slid from a first position to a second position; and an actuator carried by the storage compartment and forcibly biasing the slide toward the second position and when activated allowing the slide to move from the first position to the second position to cause the pair of locking members to move from a retracted position to an extended position, and wherein the actuator includes:

an actuator member that extends into an opening formed in the slide, the actuator member having a first portion and a second portion, wherein, when the first portion is positioned in the opening the slide is forcibly biased to the first position and when the second portion is positioned in the opening the slide is free to move from the first position to the second position; and a trigger coupled to the actuator member and adapted to move the actuator member relative to the lock assembly frame to position the second portion of the actuator member within the opening of the slide.

18. The locking of claim 17 wherein the opening formed in the slide has a wide first portion and narrow second portion and wherein the actuator member is positioned in the wide first portion of the opening when the slide is in the first position and the actuator member is positioned in the narrow second portion of the opening when the slide is in the second position.

19. The locker of claim 18 and wherein the second portion of the actuator member includes an annular groove formed in the first portion of the actuator member and wherein an edge of the slide partially defining the narrow second portion of the slot is received by the annular groove when the slide is in the second position.

20. The locker of claim 19 wherein the lock assembly further includes a lever mounted to the lock assembly frame and operatively linked with the slide, and wherein movement of the lever forces the slide from the second position to the first position.

21. The locker of claim 20 wherein the slide is linked with the pair of locking members to retract the pair of locking members from the extended position to the retracted position when the slide is in the first position.

* * * * *